US007292191B2

(12) United States Patent
Anderson

(10) Patent No.: US 7,292,191 B2
(45) Date of Patent: Nov. 6, 2007

(54) TUNABLE PLASMA FREQUENCY DEVICES

(75) Inventor: Theodore R. Anderson, Brookfield, MA (US)

(73) Assignee: Theodore Anderson, Brookfield, MA (US)

( * ) Notice: Subject to any disclaimer, the term of this patent is extended or adjusted under 35 U.S.C. 154(b) by 382 days.

(21) Appl. No.: 10/872,892

(22) Filed: Jun. 21, 2004

(65) Prior Publication Data

US 2005/0280372 A1 Dec. 22, 2005

(51) Int. Cl.
*H01Q 1/26* (2006.01)

(52) U.S. Cl. ..... 343/701; 315/111.21

(58) Field of Classification Search ..... 343/701, 343/872, 873, 785; 315/111.21–111.71
See application file for complete search history.

(56) References Cited

U.S. PATENT DOCUMENTS 5,963,169 A * 10/1999 Anderson et al. ..... 343/701
6,046,705 A * 4/2000 Anderson ..... 343/834
6,087,992 A * 7/2000 Anderson ..... 343/701
6,087,993 A * 7/2000 Anderson et al. ..... 343/701
6,118,407 A * 9/2000 Anderson ..... 343/701
6,169,520 B1 * 1/2001 Anderson ..... 343/701
6,369,763 B1 * 4/2002 Norris et al. ..... 343/701
6,492,951 B1 * 12/2002 Harris et al. ..... 343/701
6,657,594 B2 * 12/2003 Anderson ..... 343/701
6,700,544 B2 * 3/2004 Anderson ..... 343/701
6,806,833 B2 10/2004 Anderson
6,870,517 B1 * 3/2005 Anderson ..... 343/909

* cited by examiner

*Primary Examiner*—Huedung Mancuso
(74) *Attorney, Agent, or Firm*—Notaro & Michalos P.C.

(57) ABSTRACT

A plasma device serves as an antenna, single or stacked plasma frequency selective surfaces, single or stacked plasma antenna arrays, plasma lamps, plasma limiters, plasma switch, plasma windows or plasma phase shifters. An electromagnetic wave signal is controlled to have a plasma frequency matched as nearly as possible to the frequency of incident electromagnetic signals for maximizing the antenna aperture and efficiency. Matching the frequencies permits the plasma device to have a physical size and shape substantially independent of the conventional optimal size and shape for a given transceived signal frequency. The plasma device plasma frequency is adjustable for tuning to different incident signal frequencies, thereby providing flexibility not available from conventional metal antennas.

32 Claims, 6 Drawing Sheets

TUNABLE PLASMA FREQUENCY DEVICES

FIELD AND BACKGROUND OF THE INVENTION

The present invention relates generally to the field of antennas and in particular to a new and useful method and apparatus for producing small physical size plasma device antennas having large antenna apertures resulting from matching the plasma device operating frequency to that of a transmitted or received signal.

Traditionally, antennas have been defined as metallic devices for radiating or receiving radio waves. Therefore, the paradigm for antenna design has traditionally been focused on antenna geometry, physical dimensions, material selection, electrical coupling configurations, multi-array design, and/or electromagnetic waveform characteristics such as transmission wavelength, transmission efficiency, transmission waveform reflection, etc. As such, technology has advanced to provide many unique antenna designs for applications ranging from general broadcast of RF signals to weapon systems of a highly complex nature.

Included among these antennas are omnidirectional antennas, which radiate electro-magnetic frequencies uncontrolled in multiple directions at once, such as for use broadcasting communications signals. Usually, in the absence of any additional antennas or signal attenuators, an omnidirectional radiation lobe resembles a donut centered about the antenna. Antenna arrays are known for producing a directed transmission lobe to provide more secure transmissions than omnidirectional antennas can. Known antenna arrays require many powered antennas all sized appropriately to interfere on particular frequencies with the main transmitting antenna radiation lobe, and thereby permit transmission only in the preferred direction. Antenna arrays normally have a significant footprint, which increases greatly as the angular width of the transmission lobe is reduced.

Generally, an antenna is a conducting wire which is sized to emit radiation at one or more selected frequencies. To maximize effective radiation of such energy, the antenna is adjusted in length to correspond to a resonating multiplier of the wavelength of frequency to be transmitted. Accordingly, typical antenna configurations will be represented by quarter, half, and full wavelengths of the desired frequency.

Plasma antennas are a newer type of antenna which produce the same general effect as a metal conducting wire. Plasma antennas generally comprise a chamber in which a gas is ionized to form plasma. The plasma radiates at a frequency dictated by characteristics of the chamber and excitation energy, among other elements. Plasma antennas are generally known for use in a wide range of applications. See, for example, U.S. Pat. Nos. 6,657,594, 6,369,763, 6,046,705, and 5,963,169.

In particular, U.S. Pat. No. 6,657,594 discloses an antenna system in which a plasma antenna is operated at a frequency near the resonant frequency of plasma to form a more efficient radiator requiring a smaller size than metallic antenna. Plasma resonance frequency can refer to a variety of wave types which become resonant, such as plasma ion acoustic waves, plasma electrostatic waves, and plasma electromagnetic waves. However, matching of plasma frequency, as it is defined in the present invention, to operating frequency is not disclosed.

U.S. Pat. No. 6,492,951 teaches a plasma antenna as well, but also does not disclose matching of plasma frequency to operating frequency.

The inventor herein has also developed plasma loop antennas, as described in U.S. Pat. No. 6,700,544, arrays of plasma element among other variable conductive elements to form antennas in U.S. patent application Ser. No. 10/648,878 filed Aug. 27, 2003, and reconfigurable scanners using the plasma elements in U.S. patent application Ser. No. 10/693,477 filed Oct. 24, 2003, the entirety of each of which is incorporated herein by reference as if set forth in full. Any of the antennas described therein can be configured and used in the invention described further herein.

As is known in the field, efficient transfer of RF energy is achieved when the maximum amount of signal strength sent to the antenna is expended into the propagated wave, and not wasted in antenna reflection. This efficient transfer occurs when the antenna is an appreciable fraction of transmitted frequency wavelength. That is, the antenna geometry is matched to the incident or transmitted frequencies expected to be encountered. The antenna will then resonate with RF radiation at some multiple of the length of the antenna. Due to this, metal antennas are somewhat limited in breadth as to the frequency bands that they may radiate or receive because their length is not easily or accurately adjusted. Often, antennas used to transceive signals across a range of signals will have an antenna geometry selected to most closely match that of a center frequency in the intended operating frequency range. This results in an increasingly inefficient antenna as the frequencies of the incident signals progress toward the ends of the range.

Recently, wireless communications have become more and more important, as wireless telephones and wireless computer communication are desired by more people for new devices. Current wireless communications are limited to particular ranges of the electromagnetic frequency spectrum. High-speed communications are limited by the selected frequency spectrum and number of users which must be accommodated. For example, 3G networks can presently provide a maximum data transfer rate of up to 2 Mbps, shared among network users.

Growth in the demand for wireless communications makes clear that more and more such devices will be needed for a variety of functions. And, different devices of the same type may still operate on different frequencies within a selected range to avoid interference. As consumers become used to high-speed Internet connections at home and work, they will demand efficient wireless data transfer as well. Therefore, there is a need to provide a more efficient, yet portable, antenna for quickly adapting to provide maximum aperture and efficiency at any number of frequencies.

Further, from a manufacturing standpoint, it is more efficient to install one type and size antenna into each of several types of devices or different versions of the same device, and subsequently configure the antenna in a particular device to operate on a selected frequency, independent of the geometry. Such capability would provide greater flexibility in the miniaturization of portable devices, as the geometry of the antenna would no longer be limiting by the design; alternatively, the design of the device would not be limiting by the transceiving efficiency.

SUMMARY OF THE INVENTION

It is an object of the present invention to provide an antenna or other plasma device, which has a small physical size, but a large antenna aperture for selected frequencies.

It is a further object of the invention to provide a method for producing better antenna characteristics from a plasma device having a physical size that is other than optimal for a given transmitted or received frequency.

Yet another object of the invention is to provide a plasma device or antenna and a method for operating the antenna or device having high efficiency and large antenna aperture regardless of the particular plasma antenna geometry.

Accordingly, a plasma device is provided having an ionizable substance for forming a plasma contained within a chamber having electrodes or other mechanism for passing an ionizing current to the substance to form the plasma. When operating, the plasma has a plasma frequency determined by the ionizing current. The plasma inside the chamber defines an antenna or other plasma device having a selected geometry and which can be connected to a transmitter, receiver, or transceiver for driving or receiving on the antenna at a selected signal, or operating, frequency.

During operation, the plasma frequency and operating frequency are selected to maximize the antenna efficiency and antenna aperture, given the antenna geometry. The size and geometry of the plasma device may be selected without consideration for the intended operating frequency. The plasma device geometry affects how the plasma frequency is matched to the operating frequency by a geometric factor, typically between 0.3 and 3. Typically, the plasma frequency is multiplied by a geometric factor to determine the operating frequency. As a practical matter, the geometric factor is close to 1 (in fact, $1/\sqrt{2}$ for a cylinder with a radius much less than a wavelength of the of the received and transmitted wave and $1/\sqrt{3}$ for a sphere with a radius much less than a wavelength of the of the received and transmitted wave) but in any case sufficiently close to 1 so that when the plasma and operating frequencies are made approximately equal, the antenna aperture is optimized. Using this relationship, a plasma device of any size and shape can be configured to produce optimal antenna characteristics for any operating frequency simply by adjusting the plasma frequency of the plasma device.

More generally the geometric factor by which the plasma frequency is multiplied to equal the operating frequency of the electromagnetic radiation to be transmitted or received by the device of the present invention, can be from about 0.2 to about 3.0, and will depend on the geometry of the plasma container. Not only cylindrical (geometric factor $2^{-1/2}$) and spherical (geometric factor $3^{-1/2}$) containers can be used, but helical tubes of plasma, cones, pyramids or any other regular or non-regular volume can contain the plasma, with the appropriate factor calculated, estimated or observed for that geometry. Also, the frequency matching of the invention can be achieved either by controlling the plasma frequency, or by controlling the operating frequency, or both. For a container of more than a few wavelengths of the electromagnetic radiation in size in all directions, the geometric factor is 1.

When the device operating frequency is equal to or near the plasma frequency, total noise decreases by the effects of coherent electron motion. These noise sources can be thermal or shot or phase noise for example. Thus, low thermal or shot or phase noise is desired.

The phase, thermal and shot noise can be reduced according to the invention by one or more of the following:

1. pulsing the plasma with pulses of alternating polarity;

2. operating the plasma device in the afterglow state;

3. operating the plasma device such that the average DC current is zero;

4. operating the plasma device or antenna at or near the plasma frequency; and/or 5. using naturally radioactive gas like radon or radioactive seeds in other inert gas and/or mercury vapor.

Plasma from ionized pure inert gas such as Argon has lower thermal, shot, and phase noise than plasmas from ionized mixed inert gases including Mercury Vapor. Pure Argon may exhibit a well defined plasma frequency resonance whereas mixed inert gases or Mercury vapor may not.

The plasma device may be a plasma antenna, an array of plasma antennas, nested plasma antennas, one or more plasma frequency selective surfaces, a plasma filter, a plasma reflector, a plasma shield for a separate antenna, a plasma lamp in a microwave device, a plasma limiter, a plasma switch, a plasma window, a plasma screen, a plasma phase shifter, or other plasma device that uses the principles of the present invention.

A controller for matching the plasma frequency to the operating frequency given the selected geometry as nearly as possible during operation of the antenna is provided. Matching the plasma frequency and the operating frequency results in an optimal antenna aperture. The controller may be manual or automatic, such as a digital signal processor control.

The operating signal source may be any source which emits electromagnetic waves, including the plasma device itself.

Different ionization mechanisms which permit controlling the plasma frequency can be utilized, including direct and external excitation with electromagnetic energy in the form of lasers with and without fiber optics and radio frequency (RF) sources, among others.

A method for operating the plasma device includes sampling an incident signal operating frequency, adjusting a plasma frequency of the plasma device to be as close as possible to the operating frequency, resampling the incident signal operating frequency and readjusting the plasma frequency to match the operating frequency until the antenna aperture for the plasma device is optimized.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
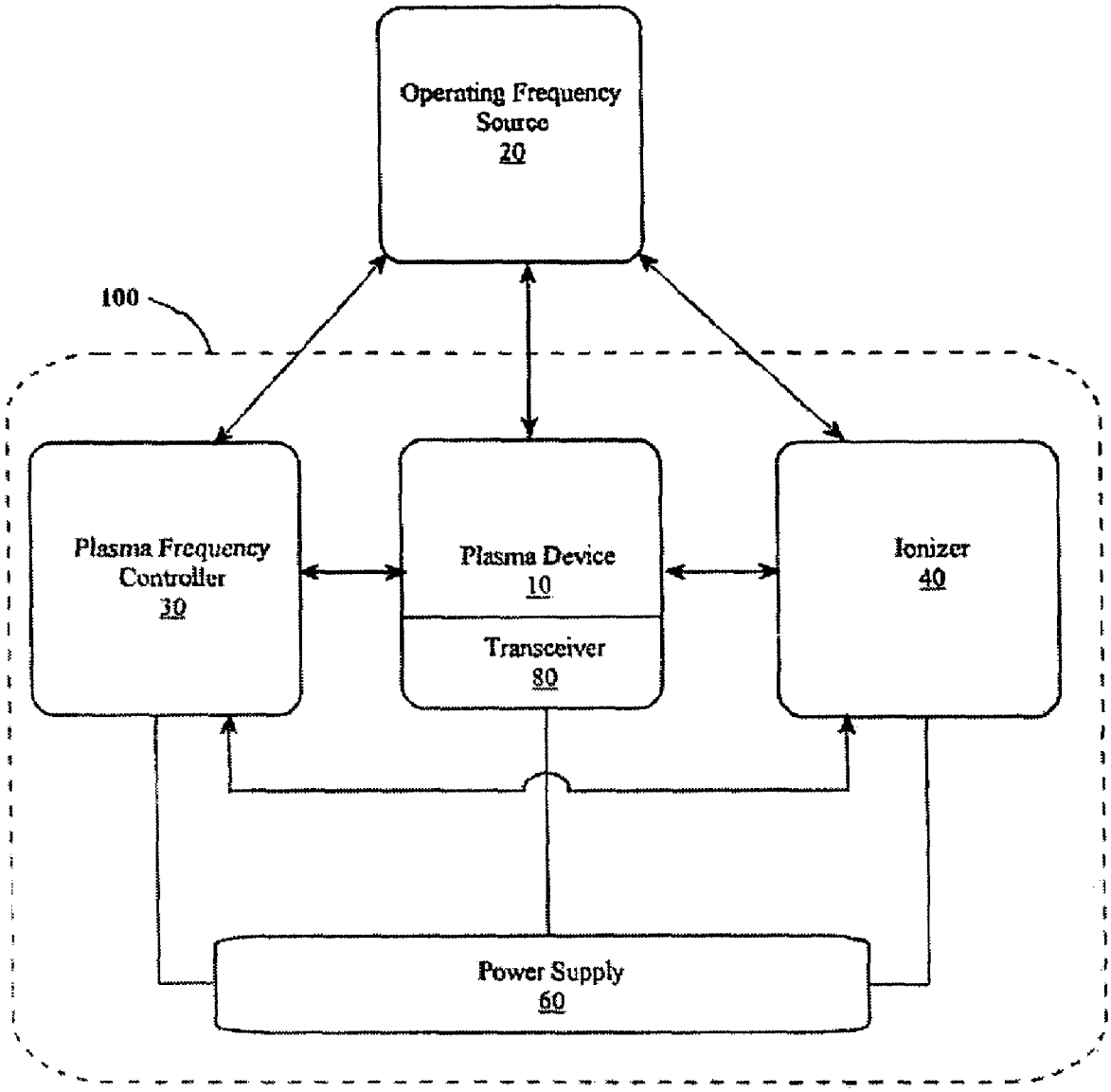
FIG. 1 is a diagram illustrating interaction between components of the tunable plasma device system.

Certain terms and the physics of reflection and transmission of electromagnetic waves through plasma will first be discussed briefly for a better understanding of the invention. In particular, the following definitions are needed to best understand the invention.

When an electromagnetic wave from an antenna of frequency $\omega$ is incident on a plasma with a plasma frequency $\omega_p$, the plasma density is proportional to the square root of the density of unbound electrons in the plasma and is a measure of the amount of ionization in the gas of the plasma. The plasma frequency $\omega_p$ is thus defined as:

$$\omega_p = \sqrt{\frac{4\pi n_o e^2}{m}}$$

where: $n_o$ is the density of unbound electrons, e is the charge on the electron, and m is the mass of an electron.

If the incident antenna frequency on the plasma is much greater than the plasma frequency, so that $\omega \ggg \omega_p$, the antenna radiation passes through the plasma without attenuation. And, when the incident frequency is much smaller than the plasma frequency, whereby $\omega \ggg \omega_p$, the plasma becomes a very good reflector with a non-lossy reactive skin depth. At plasma frequencies in between these two extreme conditions, the plasma is a good absorber of incident frequencies. This permits a plasma device to be used as a reconfigurable shield, filter, or antenna for electromagnetic signals.

Antenna aperture is defined as the ratio of power delivered to a connected load to incident intensity of a transceived signal.

Geometric and inverse geometric factors are defined as follows.

$$\omega_p = (\text{inverse geometric factor})\omega$$

$$\omega = (\text{geometric factor})\omega_p$$

The geometric factor for a cylinder is $1/\sqrt{2}$, where the radius is much less than a wavelength. The geometric factor for a sphere is $1/\sqrt{3}$, where the radius is much less than a wavelength. If the plasma device is many wavelengths in size in all directions, the geometric factor equals one.

As used herein, the terms interpreting and transceiving are intended to include either or both of transmitting from and reception by the plasma device of incident source signals or only one of these functions. That is, the plasma device may be connected to a one-way or two-way device capable of using the incident source signals, for example, a television or a mobile phone. The term transceive is not intended to be limiting and require that the plasma device both transmit and receive signals unless specifically stated herein.

Source signals include those originating at a remote location and disconnected from the plasma device, or from any device capable of generating electromagnetic signals for wireless communication to which the plasma device is connected for transceiving the signals.

The term operating source includes an antenna transmitter from the same or other antenna, a microwave oscillator, or any other source that emits electromagnetic waves.

The plasma device used for transceiving is any device that uses plasma as a variable conducting medium or variable shield. The plasma device may be any known type of plasma antenna for example. Any linear dipole, traveling wave antenna, Yagi antenna, log periodic antenna, horn antenna, or aperture antenna formed with a plasma element can be used for the plasma device herein. Thus, the plasma element may be formed as a rod, a circular loop, a helix, a coil, an ellipse, a rectangle, a spiral or another shape suitable for emitting or receiving a signal. An antenna is only one exemplary form that a container of plasma may take. A container of plasma may also take the form of frequency selective surfaces.

The term plasma device is intended to include single element plasma antennas, arrays of plasma elements, such as those arranged in multiple rows and columns on a substrate, and multiple arrays of plasma elements forming filters, reflectors, plasma limiters, plasma switches, plasma windows, plasma screens, plasma lamps, plasma phase shifters and large bandwidth antennas, among other types. The substrates supporting arrays can be flat, or planar sheets rolled into a cylinder shape, for example. Further, the plasma device can include substrates having switchable plasma regions surrounding air or other dielectrics in fixed gaps or slots, so that the effective size of the fixed slots can be changed rapidly. Substrates used to support the arrays are preferably dielectric, but may also be made from a conductive metal. The plasma elements may be ionizable to a single length or multiple lengths.

Alternatively, the plasma elements can be formed as linear conductors, rectangles, stars, crosses or other geometric shapes of plasma tubes. However, tuning the plasma frequency of plasma elements of different geometric shapes can be problematic, especially where a multipath scenario is involved. For example, a plasma element may be in the form of a cylindrical annular ring. As electromagnetic waves pass through the plasma cylindrical annular ring, phase shifting may occur along different paths of this multipath scenario. It is possible to control phase shifting while tuning the plasma frequency by simply controlling the plasma density of the plasma cylindrical annular ring device.

Other configurations of the plasma devices include one or more stacked layers, with each layer being a switchable array of plasma elements. The layers are spaced within one wavelength of adjacent layers to ensure proper function. Each switchable array in the stack can be a filter, a polarizer or a phase shifter, a deflector, or a propagating antenna. The layers are combined to produce a particular effect, such as producing a steerable antenna transmitting only polarized signals in specific frequency bands. The layers may be formed from nested plasma element antennas as well. The apertures of each layer can be individually adjusted in accordance with the invention herein to produce an optimal effect for a given incident signal frequency.

A plasma antenna array or plasma frequency selective surfaces (plasma filters), planar or linear, will have a sharp resonance at the plasma frequency. If these arrays are stacked in layers, a sum of many resonances results. Tuning any number of them on or off results in a multiband antenna or multiband frequency selective surface.

By nesting one plasma antenna inside another and operating at the plasma frequency, a bandwidth which is the sum of several very tuned bandwidths results. Any number of the nested antennas can be turned on or off to create a multiband antenna.

Referring now to the drawings, in which like reference numerals are used to refer to the same or similar elements, FIG. 1 shows a diagram of the components used in the antenna system 100 of the invention and the interactions between the components and a remote source 20. A plasma device 10 is connected with a transceiver 80 to transmit or receive electromagnetic wave signals for use by the transceiver 80. The plasma device 10 is connected with an ionizer 40 for ionizing a plasma inside the plasma device to a frequency determined by plasma frequency controller 30. Power is delivered to each component by power supply 60.

Ionizer 40 may be any direct or external mechanism for ionizing a noble gas or other ionizable material to form a plasma. For example, ionizer 40 may be a regulated power source connected to plasma device 10 by electrodes for delivering an ionizing current or voltage to form a plasma from the ionizable material. The plasma in the plasma device may be maintained in a weakly or weakly partially ionized state by a power source, such as a battery, laser, voltage source, a radiation source or radioactive source in a known manner, so that the plasma is more easily fully energized by the incident signal. Other mechanisms for creating the plasma include direct and external excitation with electromagnetic energy in the form of lasers, both with and without fiber optics, and radio frequency (RF) sources, among others.

One advantage of creating the plasma using continuous application of energy such as voltage, laser ionization, radio-frequency ionization, ionization from radioactive gases, radioactive seeds, and/or radioactive materials, is that, in effect, the plasma is in a sustained afterglow state, that is the calmer period when the exited electrons of the plasma are recombining with the ion nuclei appears to be continuous. During afterglow, the thermal, shot and phase noise are all reduced.

Noise can also be reduced when generating the plasma using DC pulses, by using relatively short positive pluses, e.g. on the order of a micro or nanosecond, followed by a relatively longer rest (afterglow) period, e.g. on the order of a millisecond, followed by the next short DC pulse which is equal to the first, but negative. With these short plasma generating and opposite pulses that average zero over time, the afterglow and therefore low noise periods are maximized.

Noise is best reduce when the electromagnetic transmitting and/or receiving (interpreting) occurs only during the afterglow period. For example in a pulsed device, the radiation is transmitted only when power pulses are not present.

Another discovery of the inventor and feature of the invention which produces enhanced aperture and/or reduced noise for the plasma devise, is to control at least one of the plasma frequency and the operating frequency so that the plasma frequency is at least twice but preferable many more times the operating frequency, e.g. 10 or 20 times or even up to infinite times the operating frequency. This is because theoretically, at infinite times the operating frequency the plasma antenna acts like a solid metal antenna.

Also the invention can create a tunable plasma frequency device such as one that can tune the plasma frequencies in various parts of the device to phase shift multiple propagation through the device in a multipath scenario such as to cause the propagations to add in phase. In other words, in a "last mile" or cell phone usage when multiple signals from the same source bounce of local structures and reach the plasma device at different times, only those with the same phase can be detected and passed to the receiving device. The plasma device of the invention in this embodiment would have a geometry that is susceptible to this directional feature, such as a donut shape when the plasma device can be controlled in different ways at different sectors around the donut.

Returning to FIG. 1, plasma frequency controller 30 is used to adjust the plasma frequency of a plasma device based on the frequency of the operating source. The plasma frequency controller can be an automated controller, such as a digital signal processor, or a manual control, such as a knob connected with a circuit for adjusting the frequency, or a combination thereof.

A large aperture, greater scattering cross-section, greater inelastic cross section, greater current in plasma and/or large electric field, and low thermal, phase and shot noise result when the plasma frequency is matched to the operating frequency.

For a sharper resonance and high coherent electron motion, the plasma frequency should be well defined as in a pure plasma gas or a plasma gas of one element such as an inert gas. Noise can be reduced if pure gases like Argon are used.

When an incident electromagnetic wave of a given frequency is incident on a container filled with plasma and the plasma frequency is matched to this frequency, large aperture scattering takes place. This aperture scattering means that if the device is an antenna, the antenna aperture increases.

The plasma antenna aperture has a maximum aperture when the antenna frequency is operated at the plasma frequency. This applies to both transmission from and reception by the plasma device of incident source signals. This also applies independent of the antenna geometry except for factors times the plasma frequency less than 10. For example when plasma is in a cylinder, the effective plasma frequency is the plasma frequency divided by the square root of 2. If in a spherical geometry the effective plasma frequency is the plasma frequency divided by the square root of 3. Hence, an electrically small plasma antenna can have the same aperture as a larger metal antenna which is resonant based on geometry. The plasma antenna aperture can be enhanced if the plasma antenna is geometrically resonant (e.g, at one half wavelengths long) and the plasma density is changed to match the plasma frequency. If the plasma frequency selective surfaces have plasma densities which match the plasma frequency, their reflective ability increases as well.

Also, the aperture is maximum and thermal, shot, and phase noise is low when the plasma frequency is equal to the operating frequency for device geometries that are large in all directions compared to the electromagnetic waves absorbed, reflected, or transmitted by the plasma device. When the device is small compared to the wavelengths in a given direction than the plasma frequency gets multiplied by a geometric factor characteristic of the device which is close to one. For example for a plasma device of cylindrical geometry of radius much smaller than the wavelength, the geometric factor is one over the square root of 2. For a plasma device of spherical geometry of radius much less than said wavelength, the geometric factor is one over the square root of 3. Another operating mode with significant aperture of a plasma derive to transmit electromagnetic waves is that the operating frequency is at least twice the plasma frequency, but typically ten times the plasma frequency. This would be effectively a geometric factor of 2 and 10 respectively. The higher the effective geometric factor the more the plasma device behaves as a metal.

For plasma devices there are two resonances that can be used to enhance aperture that can be used in themselves or simultaneously. One is the same resonance that occurs for the corresponding metal device such as a dipole antenna one half wavelength long. This same resonance to enhance aperture and efficiency in the metal is also true for the corresponding plasma device. In addition the plasma device has another resonance when the operating frequency equals the plasma frequency times the geometric factor which in plasma devices with plasma larger than many wavelengths in all directions is equal to one.

The plasma can be operated in a continuous or afterglow state. The afterglow state is when the ionization takes place by pulsing the plasma rather than the continuous application of an ionization potential. In between pulses, the noise in the plasma decreases when the plasma relaxes. As the plasma density changes such that the plasma frequency becomes equal to the operating frequency, noise (such as thermal, phase and shot noise) in the plasma becomes minimized due to the fact that the plasma is in the afterglow and the plasma frequency equals the operating frequency. A plasma device can be operated such that the plasma density can be maintained where the plasma frequency is at or close to the operating frequency by maintaining the ionization by pulsing. This is a matter of timing the pulse repetition frequency and the plasma relaxation or decay time in the afterglow such that the plasma frequency is at or close to the operating frequency.

In addition, the plasma can be ionized by pulsing with opposite alternating positive and negative polarity to reduce noise such as thermal, phase and/or shot noise.

A method for matching the plasma frequency to the operating frequency of a plasma device a plasma device includes also sampling the source operating signal to determine the operating frequency and adjusting the plasma frequency of the plasma device to approximate the operating frequency. The operating signal may be resampled to verify the operating frequency and the plasma frequency may be adjusted to approximate the verified operating frequency. The plasma frequency can therefore be adjusted to the operating frequency ±10% of the operating frequency.

Figure 2:
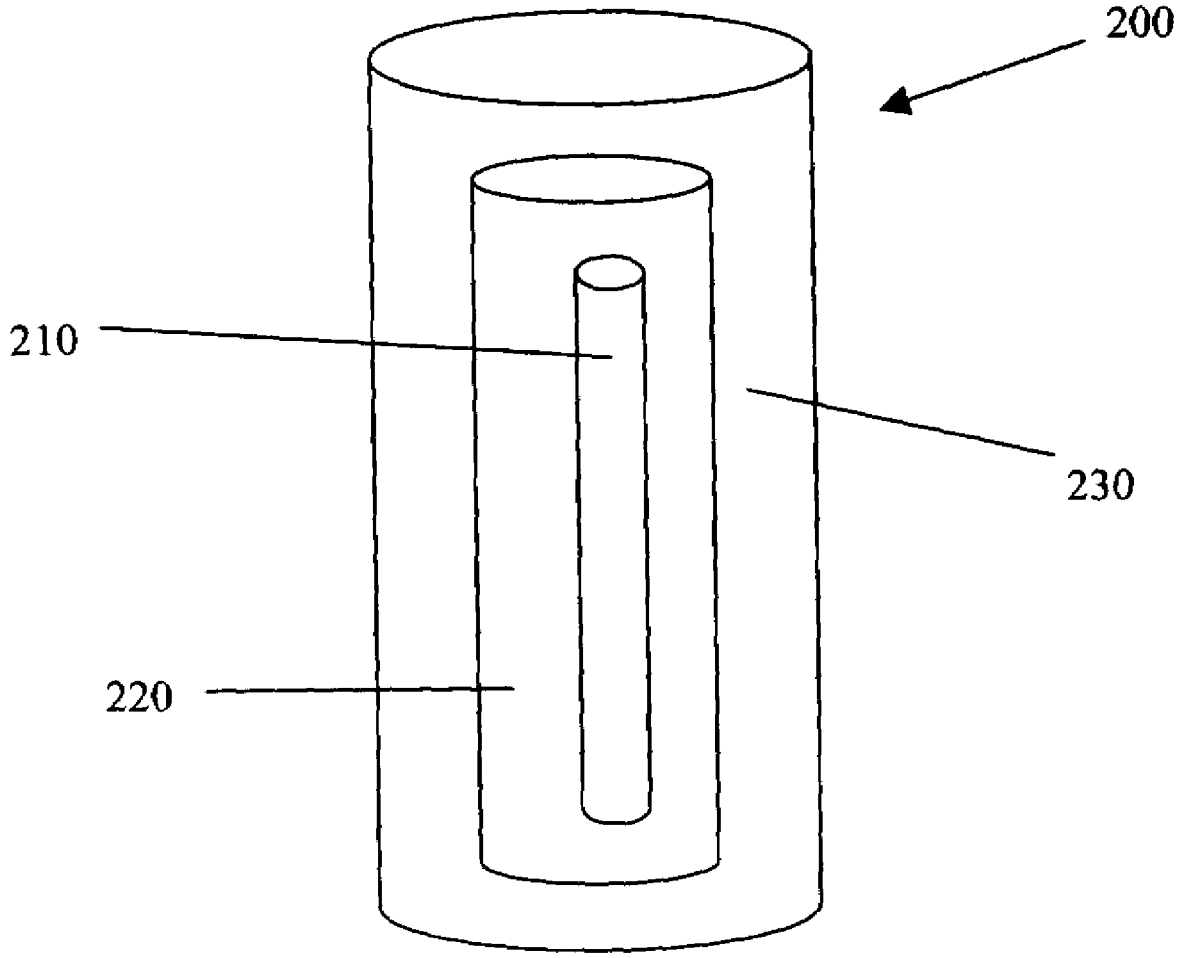
FIG. 2 is a diagram of a nested plasma dipole antenna.

In another preferred embodiment of the invention, the plasma device is a nested plasma dipole antenna, as shown in FIG. 2. FIG. 2 shows a nested plasma dipole antenna 200 containing a plasma antenna 210 which is the innermost plasma antenna with the highest frequency, a plasma antenna 220 which is outside plasma antenna 210 and has an intermediate frequency, and a plasma antenna 230 which is the outermost plasma antenna with the lowest frequency. All the plasma antennas are operated at the plasma frequency where aperture is high and independent of antenna length. The inner higher frequency plasma antenna 210 propagates through the outer lower frequency plasma antennas 220 and 230. Both resonances of the plasma antenna are used to fully enhance aperture. The geometric resonance (for example a dipole of one half wavelength in length which is the same as for a metal antenna) and the plasma frequency resonance to yield a resonance in the aperture are used simultaneously to enhance aperture from the two physical phenomena.

The basis for determining the relationship between the optimal plasma frequency relative to an incident or transceived signal frequency is as follows. A linearized, zero-temperature fluid model of the plasma was used to describe a column of neutral plasma interacting with an incident electromagnetic field. The elastic and inelastic scattering cross sections are derived and numerically evaluated as a function of incident frequency and plasma frequency. The scattering cross sections are strongly peaked at the plasma frequency. The reciprocity theorem is used to determine the behavior of such a plasma column under transmitting conditions (i.e. as an antenna). This analysis shows that the plasma antenna can be designed to strongly radiate for wavelengths longer than twice the antenna length.

The derivation begins with equations governing the behavior of the plasma charge and current densities which are defined as:

$$\rho(\vec{r}, t)=e[p(\vec{r}, t)-n(\vec{r}, t)], \tag{1}$$

and $$\vec{J}(\vec{r}, t)=e[p(\vec{r}, t)\vec{v}_p(\vec{r}, t)-n(\vec{r}, t)\vec{v}_n(\vec{r}, t)], \tag{2}$$

respectively. In equations (1) and (2), $p(\vec{r},t)$ and $n(\vec{r}, t)$ refer to the volume number density of positive and negative charges respectively, e is the elementary unit of charge (given as a positive number and $\vec{v}_p(\vec{r}, t)$ and $\vec{v}_n(\vec{r}, t)$ are the respective velocity fields associated with positive and negative fields.

Local charge imbalance gives rise to an electrostatic potential $\phi$ which is determined by Poisson's equation (using cgs units):

$$\nabla^2\phi(\vec{r}, t)=-4\pi e[p(\vec{r}, t)-n(\vec{r}, t)], \tag{3}$$

Then, a fixed degree of ionization is assumed in the plasma, so that each charge species can be considered to be locally conserved. These assumptions give rise to continuity equations connecting the charge and current densities of each charge species separately:

$$\frac{\partial\rho_p}{\partial t}=-\vec{\nabla}\cdot\vec{J}_p, \tag{4}$$

and, $$\frac{\partial\rho_n}{\partial t}=-\vec{\nabla}\cdot\vec{J}_n, \tag{5}$$

where the following definitions are used for the individual charge and current densities:

$$\rho_p(\vec{r}, t)=ep(\vec{r}, t) \tag{6}$$

$$\vec{J}_p(\vec{r}, t)=e\vec{v}_p(\vec{r}, t)p(\vec{r}, t) \tag{7}$$

$$\rho_n(\vec{r}, t)=-en(\vec{r}, t) \tag{8}$$

$$\vec{J}_n(\vec{r}, t)=-e\vec{v}_n(\vec{r}, t)n(\vec{r}, t) \tag{9}$$

A set of linear equations can be obtained by considering small deviations from charge neutrality. Thus:

$$p(\vec{r}, t)=p_o+\delta p(\vec{r}, t), \tag{10}$$

$$n(\vec{r}, t)=n_o+\delta n(\vec{r}, t), \tag{11}$$

where for a neutral system, $n_0=p_0$ and it is assumed that $\delta p$ and $\delta n$ and both small. Then, using equations (10) and (11), the continuity equations (4) and (5) are linearized as follows:

$$\frac{\partial\rho_p}{\partial t}=-ep_o\vec{\nabla}\cdot\vec{\upsilon}_p, \tag{12}$$

$$\frac{\partial\rho_n}{\partial t}=+en_o\vec{\nabla}\cdot\vec{\upsilon}_n, \tag{13}$$

Finally, changes in the velocity fields are governed by Newton's equations of motion:

$$M\left[\frac{d\vec{\upsilon}_p}{dt}+\gamma_p\vec{\upsilon}_p\right]=+e\left[\vec{E}(\vec{r},t)-\vec{\nabla}\phi(\vec{r},t)\right], \tag{15}$$

for the positive charges, and:

$$m\left[\frac{d\vec{\upsilon}_n}{dt}+\gamma_n\vec{\upsilon}_n\right]=-e\left[\vec{E}(\vec{r},t)-\vec{\nabla}\phi(\vec{r},t)\right], \tag{16}$$

for the negative charges. In equations (15) and (16), $\vec{E}$ is an externally applied electric field, M is the mass of the positive species (typically ions) and m is the mass of the negative species (typically electrons). The equations also include phenomenological damping terms characterized by the positive and negative species collision frequencies $\gamma_p$ and $\gamma_n$, respectively.

The equation of motion for the current density can now be derived by differentiating equation (2) and substituting equations (12), (13), (15) and (16) to produce:

$$\frac{\partial\vec{J}}{\partial t}=e^2\left(\vec{E}-\vec{\nabla}\phi\right)\left[\frac{p_o}{M}+\frac{n_o}{m}\right]+e\vec{\upsilon}_p\left(-p_o\vec{\nabla}\cdot\vec{\upsilon}_p\right)-e\vec{\upsilon}_n\left(-n_o\vec{\nabla}\cdot\vec{\upsilon}_n\right) \tag{17}$$

Equation (17) is linearized by dropping the last two terms of the equation. Another simplification is obtained by observing that typically, the ionic mass is much larger than the electron mass (M>>m), thereby justifying elimination of the $p_O/M$ term in equation (17) as well. Physically, this assumption corresponds to the assumption that positive charge density it essentially uniform with the constant value $p_O$.

This completes the derivation of the fluid model, resulting in the following three linear equations for solving simultaneously:

$$\frac{\partial\vec{J}}{\partial t}+\gamma\vec{J}=\frac{\omega_p^2}{4\pi}\left(\vec{E}-\vec{\nabla}\phi\right), \tag{18}$$

$$\frac{\partial\rho}{\partial t}=-\vec{\nabla}\cdot\vec{J}, \tag{19}$$

$$\nabla^2\phi=-4\pi\rho. \tag{20}$$

It should be noted that the subscript of the collision frequency, $\gamma$, has been dropped in equation 18, and the plasma frequency $\omega_p$ is introduced. The plasma frequency $\omega_p$ is repeated here again for convenience, and represents the frequency of free plasma oscillations in the absence of an applied field:

$$\omega_p=\sqrt{\frac{4\pi n_o e^2}{m}}, \tag{21}$$

Using the equations derived above, the next task is to consider scattering of electromagnetic radiation from a cylindrical column of plasma characterized by the fluid model defined by equations (18), (19) and (20). The incident field is assumed to be a plane wave polarized along the length of the plasma column. The field of equation (18) is thus given by:

$$\vec{E}(\vec{r},t)=\hat{z}E_o\cos(\omega t-\vec{k}_\perp\cdot\vec{r}). \tag{22}$$

w here k⊥, the propagation vector, lies in the x-y plane.

It is assumed that the plasma exists in a container that the RF radiation can pass through, and is preferably invisible to RF radiation. The container, in one embodiment of the invention, is a right circular cylinder of length L aligned with the z-axis and radius a. The system is restricted to wavelengths in the range $0\leqq 2\lambda\leqq 2L$, and it is assumed as well that the radius a is much smaller than length L. Typically, as a practical matter, the radius is preferably one-sixth of L, or a=L/6. These assumptions permit elimination of the spatial dependence of the phase factor in equation (22), so that equation (18) is further simplified to:

$$\vec{E}(\vec{r},t)=\hat{z}E_o\cos(\omega t), \tag{23}$$

As a result, the three equations (18), (19) and (20) can be combined into a single equation stated in terms of the current density J, which can be solved by Fourier Transformation upon application of appropriate boundary conditions. Physically, the current density must vanish at the ends of the cylindrical container. The ends of the container are defined as J(z=0, t)=J(z=L, t)=0. Thus, the current density is expanded as a Fourier sine series:

$$\vec{J}(\vec{r},t)\equiv\vec{J}(z,t)\Big|_{x^2+y^2\leq a^2}=\hat{z}\cos(\omega t+\alpha(\omega))\sum_{i=1}^{\infty}a_1\sin(l\pi z/L). \tag{24}$$

$\vec{\nabla}\phi$ and $\partial\vec{J}/\partial t$ can be obtained by simple manipulation of equations (19) and (20), and substitution of equation (24) as shown below:

$$\vec{\nabla}\phi=\frac{4\pi\hat{z}}{\omega}\sin(\omega t+\alpha(\omega))\sum_{l}^{\infty}\sin(l\pi z/L),\text{ and} \tag{25}$$

$$\frac{\partial\vec{J}}{\partial t}=-\omega\hat{z}\sin(\omega t+\alpha(w))\sum_{l}^{\infty}\sin(l\pi z/L), \tag{26}$$

A single linear equation for $\vec{J}$ can be obtained by substituting equations (25) and (26) in equation (18). The Fourier coefficients $a_1$ are obtained by multiplying through by sin (lπz/L)/L and integrating from 0 to L. Thus, non-zero coefficients result only for odd integers l=2q−1, which permits a determination of both $a_{2q-1}$ and the phase $\alpha(\omega)$.

$$a_{2q-1}[(\omega_p^2-\omega^2)\sin(\omega t+\alpha)+\omega\gamma\cos(\omega t+\alpha)]=\frac{\omega_p^2\omega E_o\cos(\omega t)}{2\pi(2q-1)}, \tag{27}$$

The phase factor a is determined by forcing the term in brackets on the left hand side of equation (27) to be proportional to cos(ωt). The result is shown in equations (28) and (29) below.

$$\sin[\alpha(\omega)] = \frac{\omega_p^2 - \omega^2}{\sqrt{(\omega_p^2 - \omega^2)^2 + \omega^2\gamma^2}}, \tag{28}$$

$$\cos[\alpha(\omega)] = \frac{\omega\gamma}{\sqrt{(\omega_p^2 - \omega^2)^{+\omega^2\gamma^2}}}. \tag{29}$$

Using equations (28) and (29) in equation (27) leads to equation (30) below.

$$a_{2q-1} = \frac{E_o}{2\pi^2(2q-1)} \frac{\omega_p^2\omega}{\sqrt{(\omega_p^2 - \omega^2)^2 + \omega^2\gamma^2}}, \tag{30}$$

for all positive integers q(=1, 2, 3, . . . ).

At this point the current density, equation (24) is completely determined and can be used to determine the charge density. By substituting equation (30) into equation (20) and integrating with respect to time, equation (31) can be obtained as shown below.

$$\rho(\vec{r}, t) = -\frac{E_o \sin(\omega t + \alpha)}{2\pi L} \frac{\omega_p^2}{\sqrt{(\omega_p^2 - \omega^2)^2 + \omega^2\gamma^2}}, \tag{31}$$

Using the equations derived above, the next task is to consider scattering of radiation from a cylindrical column due to the presence of the incidental plane wave. The fields in the far field approximation are evaluated because of the relevance of elastic and inelastic scattering cross sections. In this approximation, the vector and scalar potentials are given by equations (32) and (33) below.

$$\vec{A}(\vec{r}, t) = \frac{e^{-jkr}}{rc} \int d\vec{r}' \vec{J}(\vec{r}', t) e^{j\hat{n}\cdot\vec{r}' k}, \text{ and} \tag{32}$$

$$\phi(\vec{r}, t) = \frac{e^{-jkr}}{r} \int d\vec{r}' \rho(\vec{r}', t) e^{j\hat{n}\cdot\vec{r}' k}, \tag{33}$$

where the unit vector $\vec{n}$ points in the direction of the observation point $\hat{n} = \vec{r}/r$.

At this point it is convenient to switch to complex exponentials for the time dependence as well as the spatial dependence as indicated in equations (32) and (33). The conversion is made by the following two replacement equations (34) and (35).

$$\cos(\omega t + \alpha) e^{-jkr} \rightarrow e^{j(\omega t + \alpha - kr)}, \tag{34}$$

and $$\sin(\omega t + \alpha) e^{-jkr} \rightarrow -j e^{j(\omega t + \alpha - kr)}. \tag{35}$$

Upon substituting equations (24) and (31) into equations (32) and (33), respectively, and invoking equations (34) and (35), integrals can be obtained for the vector and scalar potentials that can be evaluated in closed form. The results are shown below in equations (36) and (37) where a sphere coordinate system (rθφ) has been employed.

$$\vec{A}(\vec{r}, t) = -\hat{z} \frac{a^2 E_o e^{j(\omega t + \alpha - kr)}}{8cr} \frac{\tan[(kL)\cos(\theta)/2]}{k\cos(\theta)} (e^{j(kL)\cos(\theta)} - 1) \frac{\omega_p^2}{\sqrt{(\omega_p^2 - \omega^2)^2 + \omega^2\gamma^2}}, \text{ and,} \tag{36}$$

$$\phi(\vec{r}, t) = -\frac{a^2 E_o e^{j(\omega t + \alpha - kr)}}{8r} \tan[(kL)\cos(\theta)/2] (e^{j(kL)\cos(\theta)} - 1) \frac{\omega_p^2}{\sqrt{(\omega_p^2 - \omega^2)^2 + \omega^2\gamma^2}}, \tag{37}$$

The scattered electric and magnetic fields can be obtained from the well-known relations shown below as equations (38) and (39).

$$\vec{E} = -\vec{\nabla}\phi - \frac{1}{c}\frac{\partial \vec{A}}{\partial t} \tag{38}$$

and $$\vec{B} = \vec{\nabla} \times \vec{A}. \tag{39}$$

In carrying out the differentiations in equations (38) and (39) terms of order O(1/r)only need to be retained as these are the only ones that contribute in the far field. In particular, the lowest order term arising from $\vec{\nabla}\phi$ is of order $O(1/r^2)$ and can thus be neglected.

In order to evaluate the scattered flux, the radial component of the time averaged Poynting vector is evaluated by equation (40) below.

$$P_r = \left[\frac{c}{8\pi}\mathrm{Re}\left[\vec{E} \times \vec{B}^*\right]\right] \cdot \hat{n} = \frac{c}{8\pi}\mathrm{Re}[E_\theta B_\varphi^* - E_\varphi B_\theta^*], \tag{40}$$

The last term on the right hand side vanishes because $E_\varphi = 0$. In keeping only O(1/r)terms, $B_\varphi \approx \partial A_\theta/\partial r$ and $E_\theta = -(1//c)\partial A_\theta/\partial t$, where we use the relation $\hat{z} = \hat{r}\cos(\theta) - \hat{\theta}\sin(\theta)$ to extract $A_\theta$ from equation (36). The results are shown in equations (41) and (42) below.

$$B_\varphi(\vec{r}, t) = \frac{a^2 E_o e^{j(\omega t + \alpha - kr)}}{8jcr} \tan(\theta)\tan[(kL)\cos(\theta)/2] (e^{j(kL)\cos(\theta)} - 1) \frac{\omega_p^2\omega}{\sqrt{(\omega_p^2 - \omega^2)^2 + \omega^2\gamma^2}}, \text{ and} \tag{41}$$

$$E_\varphi(\vec{r}, t) = B_\theta(\vec{r}, t). \tag{42}$$

Upon substitution of equations (41) and (42) into equation (40) and dividing by the incident flux which is equation (43) below, the elastic differential scattering cross section is determined in equation (44).

$$P_{inc} = \frac{c}{8\pi}|E_o|^2, \tag{43}$$

$$\frac{d\sigma_{el}}{d\Omega} = \frac{a^2(ka)^2}{16}\tan^2(\theta)\tan^2[(kl)\cos(\theta)/2] \sin^2[(kL)\cos(\theta)/2]\left[\frac{\omega_p^4}{(\omega_p^2-\omega^2)^2+(\gamma\omega)^2}\right]. \tag{44}$$

The integral for the total elastic scattering cross section shown in equation (45) below cannot be evaluated in closed form. It has been evaluated numerically.

$$\sigma_{el} = \int\left(\frac{d\sigma_{el}}{d\Omega}\right)d\Omega = 2\pi\int_0^{\pi}\left(\frac{d\sigma_{el}}{d\Omega}\right)\sin(\theta)d\theta, \tag{45}$$

Lastly, the inelastic scattering cross section is evaluated. First, the time averaged integral of the product $\vec{E}\cdot\vec{J}$ over the volume of the plasma column is evaluated. This is done using equations (23), (24), and (30). The result is shown in equation (46) below where the angle brackets < > denote time averaging over one period.

$$\int_0^L \langle\vec{E}\cdot\vec{J}\rangle dz\Big|_{x^2+y^2\le a^2} = \frac{E_o^2a^2\pi L\cos[\alpha(\omega)]}{16}\frac{\omega_p^2\omega}{\sqrt{(\omega_p^2-\omega^2)^2+\gamma^2\omega^2}}, \tag{46}$$

By dividing through by the incident flux, equation (43), and using equation (29), the result for the total inelastic scattering is shown in equation (47) below.

$$\sigma_{in} = a^2\frac{\pi^2(kL)}{2}\frac{\gamma\omega\omega_p^2}{(\omega_p^2-\omega^2)^2+\gamma^2\omega^2}. \tag{47}$$

The results of the analysis are described below. First, FIG. 3 indirectly shows an increase in the aperture due to matching of plasma and operating frequencies. This is accomplished via the known relationship between the elastic and inelastic scattering cross-sections and aperture as shown in equation 56 below. This relationship is derived below in equations 48-55. The elastic and inelastic scattering cross sections were calculated numerically versus incident frequency and for various plasma frequencies.

Figure 3:
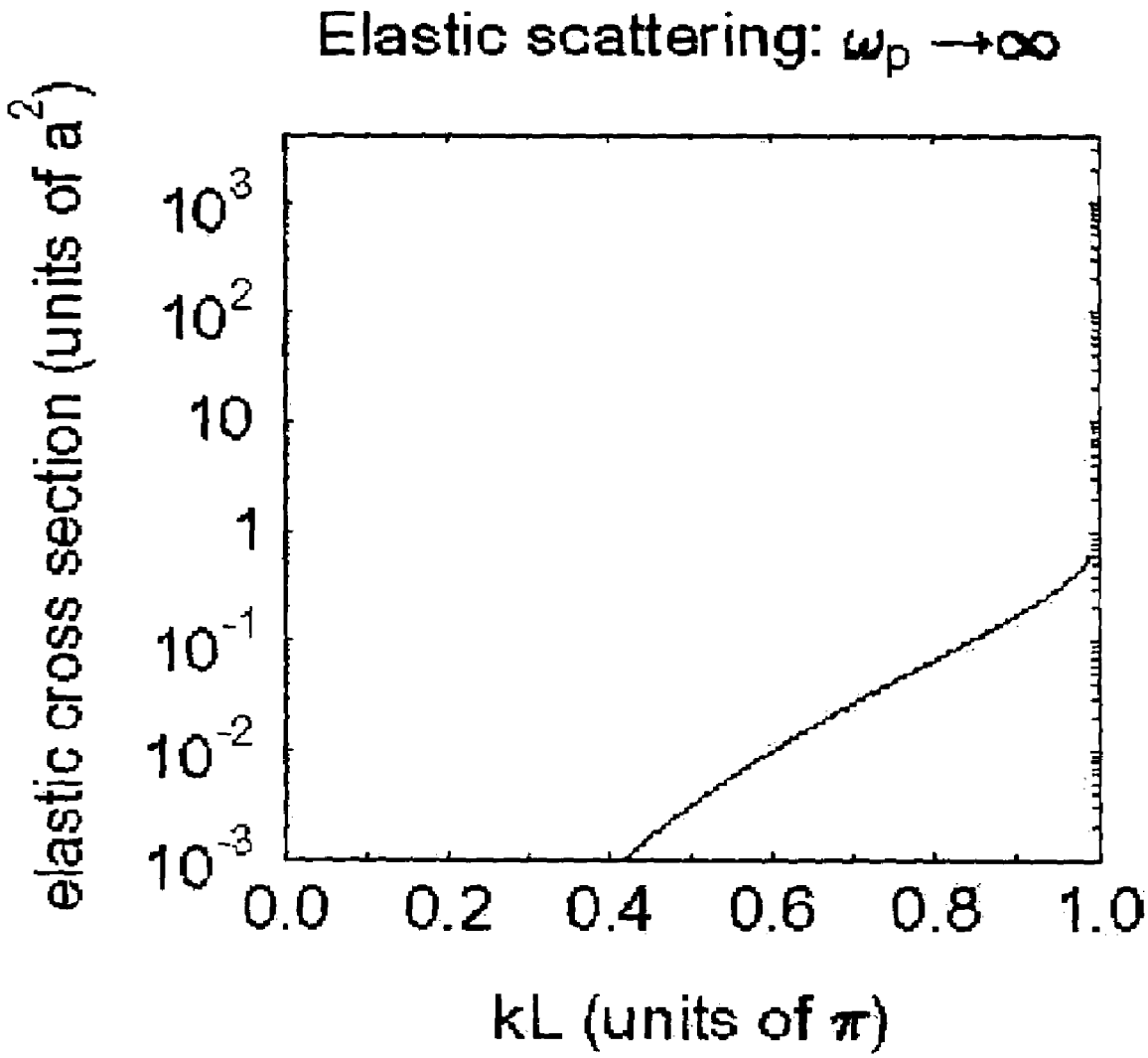
FIG. 3 is a graph plotting elastic scattering cross section versus operating frequency designated kL with dimensionless units wherein plasma frequency approaches infinity.

FIG. 3 displays the result for the elastic scattering cross section for a plasma column in the limit of a perfect metal. In other words the plasma frequency is made very large in comparison to the incident frequency. The plot in FIG. 3 shows that the aperture becomes that of a metal antenna as the plasma frequency increases. For $\omega_p=k_pL=1000\pi$ the frequency is specified in terms of dimensionless units $\omega=kL$ where the wave number k is defined in the usual way $k=2\pi/\lambda$ in terms of the wavelength $\lambda$. In these units $kL/\pi=1$ corresponds to $\lambda=2L$. FIG. 3 shows that the elastic scattering cross section is increasing as we approach $kL/\pi\rightarrow 1$. For the present discussion, the only frequencies considered are $0\leqq kL/\pi\leqq\pi$. For the plot in FIG. 3, the antenna has the largest scattering cross section at $kL/\pi=1$.

Figure 4:
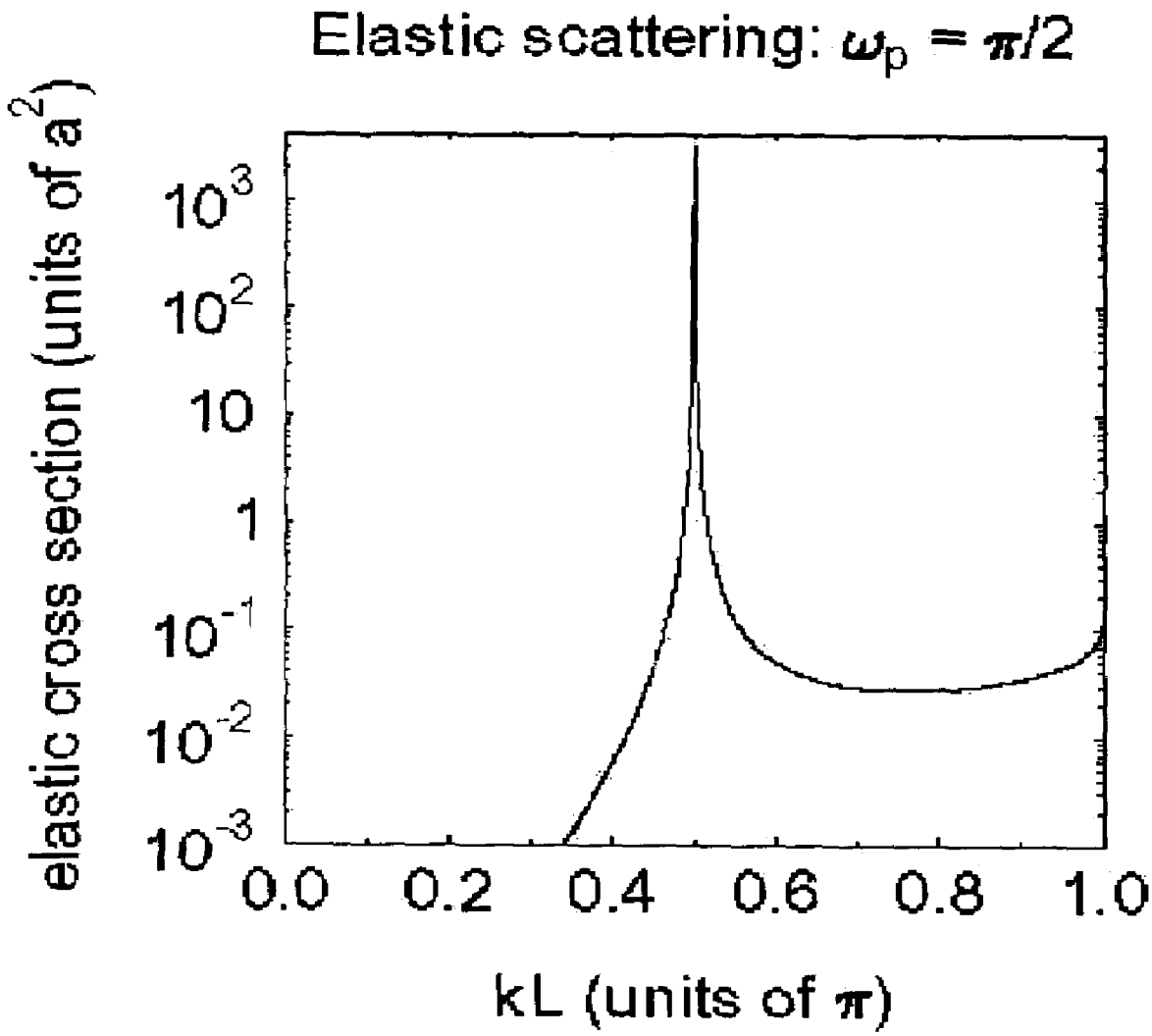
FIG. 4 is a graph plotting elastic scattering cross section versus operating frequency designated kL with dimensionless units wherein plasma frequency approaches $\pi/2$.

FIG. 4 shows a graph plotting elastic scattering cross section versus operating frequency designated kL with dimensionless units. The plasma frequency is chosen to occur at $\omega_p=k_pL/\pi=0.5$. The elastic scattering cross section at $\omega_p$ greatly exceeds its value at $kL/\pi=1$ , thus allowing longer wavelengths than $\lambda=2L$ to be strongly scattered.

The direct effect on the aperture due to matching of plasma and operating frequencies can be determined by connecting the scattering cross section with the antenna aperture. This is accomplished by the following derivation based on the following energy balance equations.

In receive mode: Power collected=(elastic cross section+inelastic cross section)incident intensity (48)

Power collected=power scattered+inelastic cross section×incident intensity (49)

Power collected=total power delivered to load+power scattered+power lost in antenna (50)

Hence, total power delivered to the load=inelastic cross section×incident intensity−power lost in the antenna (51)

However under conjugate matching: Total power delivered to the load=one half×power collected, (52)

and power scattered+power lost in the antenna=one half×power collected (53)

Aperture under conjugate matching=Total power delivered to the load/incident intensity (54)

Aperture under conjugate matching=one-half collected power/incident intensity (55)

Hence, aperture=one-half×(elastic scattering cross section+inelastic scattering cross section) (56)

Because of low collision rates in the plasma, the Ohmic losses and the inelastic cross section are negligible.

Figure 5:
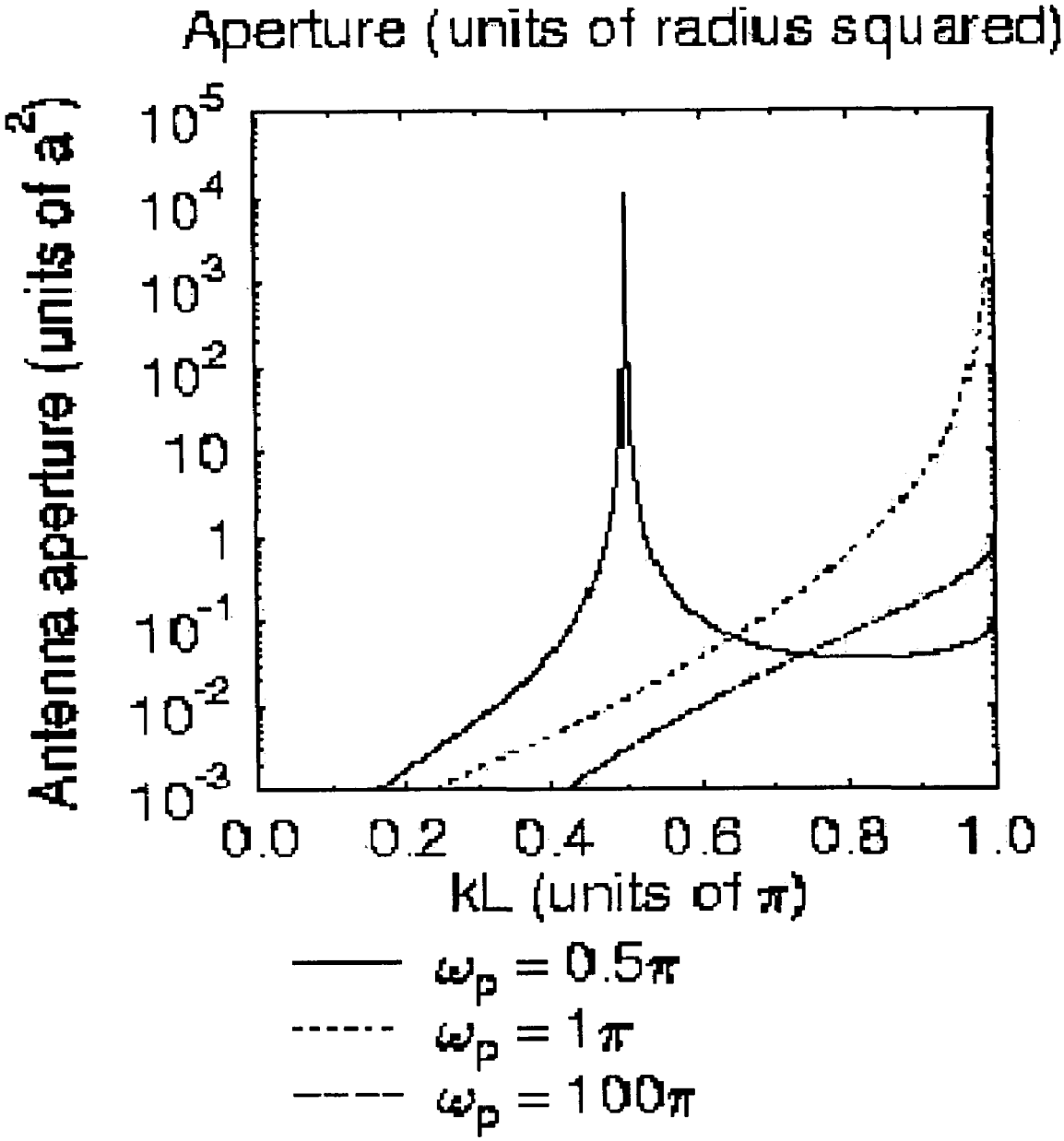
FIG. 5 is a graph plotting antenna aperture versus operating frequency with dimensionless units, wherein the resonance in the aperture is shown.

FIG. 5 plots antenna aperture versus operating frequency with dimensionless units, wherein the resonance in the aperture is shown.

Figure 6:
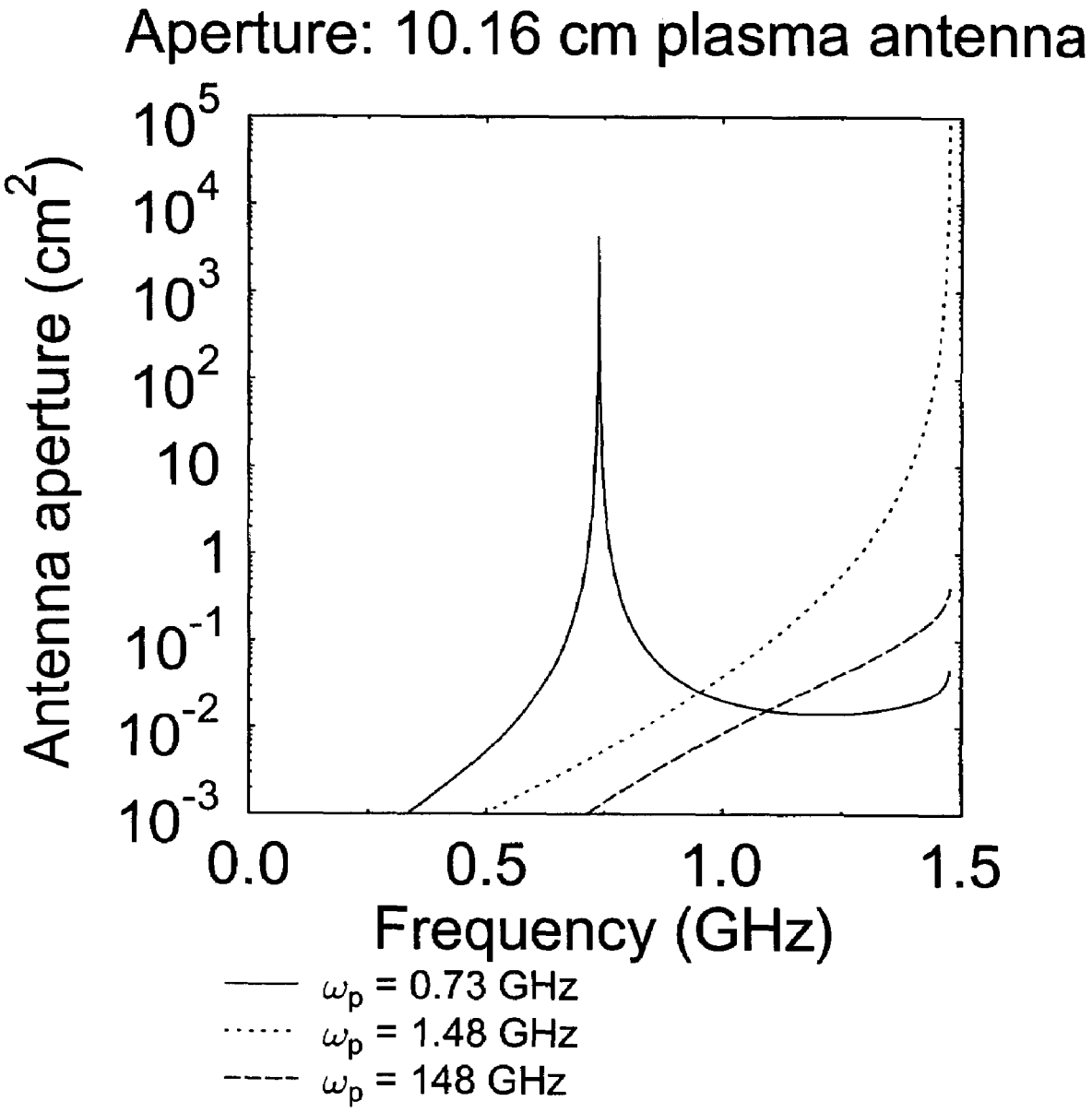
FIG. 6 is a graph plotting antenna aperture versus operating frequency with dimensional units in gigahertz.

FIG. 6 plots antenna aperture versus operating frequency with dimensional units in gigahertz. There is a resonance in the aperture when the antenna operating frequency equals the plasma frequency at 0.73 GHz. The left side of the resonance at antenna operating frequency of 1.48 Ghz can be seen. When the plasma frequency is 148 Ghz, the aperture approaches the limit of metal antennas. The aperture in the metal limit is less than when the antenna operating frequency is equal to the plasma frequency.

The plot shows that the aperture becomes that of a metal antenna as the plasma frequency increases. Referring back to the nested plasma dipole antenna embodiment above as shown in FIG. 2, it can be concluded that omnidirectional plasma antennas of less than one half wavelength long can have larger apertures than the corresponding metal antennas.

While specific embodiments of the invention have been shown and described in detail to illustrate the application of the principles of the invention, it will be understood that the invention may be embodied otherwise without departing from such principles.

What is claimed is:

1. A reduced noise, configurable plasma device comprising:

transceiver means operative to transmit and or receive electromagnetic signals having a selected operating frequency through the device;

plasma means having a plasma ionizable to a plasma frequency; and control means operative to control one of the plasma frequency of the plasma means and the operating frequency of the electromagnetic signals based on the other one of plasma frequency and operating frequency so that the operating frequency is equal or approximate to the plasma frequency times a geometric factor characteristic of the device or the plasma frequency is equal or approximate to the operating frequency times an inverse of the geometric factor, wherein the device has a cross sectional width that is less than a wavelength of the electromagnetic signals, wherein the control means comprises:

ionizing means for ionizing the plasma; and a controller operative to control the ionizing means ionize the plasma to the plasma frequency by application of plasma ionizing energy pulses, and wherein the transceiver means is adapted to transmit and or receive electromagnetic signals in a period between ionization of the plasma with the energy pulses.

2. A configurable device according to claim 1, wherein the controller comprises at least one of a digital signal processor and a microprocessor.

3. A configurable device according to claim 1, wherein the controller is operated manually.

4. A configurable device according to claim 1, wherein the plasma device has a physical shape defining a geometry corresponding to the geometry factor, and the geometry factor is used by the control means to approximate the operating frequency.

5. A configurable device according to claim 1, wherein the plasma means is a plasma antenna, a plasma linear antenna array, a plasma antenna planar array, nested plasma antennas, a plasma frequency selective surface, stacked plasma frequency selective surfaces, a plasma cylindrical annular ring around an antenna, a plasma reflector, a plasma filter, a plasma lamp, a plasma limiter, a plasma switch, a plasma window, a plasma screen, or a plasma phase shifter.

6. A configurable device according to claim 1, wherein the device minimizes total noise, including electromagnetic, phase, thermal and shot noise.

7. A configurable device according to claim 1, wherein the device maximizes plasma aperture, internal electric field in the plasma, or internal current in the plasma.

8. A configurable device according to claim 1, wherein the plasma is ionized by application of at least one of voltage, electric field, electromagnetic field, laser, acoustical waves, radio frequency waves, radio frequency excitation, and radiation.

9. A configurable device according to claim 1, wherein the plasma is ionized by application of opposite alternating positive and negative energy polarities supplied by voltage, current, laser, or RF waves to reduce power requirements, and thermal, phase, and shot noise.

10. A configurable device according to claim 1, wherein the plasma device comprises a single pure gas ionizable gas element to reduce thermal, phase and shot noise.

11. A configurable device according to claim 1, including means for operating the plasma means in an afterglow state to reduce thermal, shot and phase noise.

12. A configurable device according to claim 1, wherein the plasma means includes a container in which the plasma is ionizable to a plasma frequency such that the plasma frequency equals the operating frequency times the inverse of the geometric factor characteristic of the device.

13. A configurable device according to claim 1, wherein thermal, shot and phase noise in the plasma means is reduced when an average direct current in the plasma is zero.

14. A configurable device according to claim 1, wherein one of the device defines a first plasma antenna which are in wireless communication with a second plasma antenna comprising another one of the device, and wherein the communications between the antennas are synchronized such that the antennas are transmitting and receiving in the afterglow mode after ionization of the plasma with a selected energy pulse.

15. A configurable device according to claim 1, wherein a density of the plasma is varied such that the plasma frequency is equal to an inverse geometric factor times the operating frequency which is the square root of 2 for a cylindrical geometry with a radius much less than a wavelength of received and transmitted signals and the square root of 3 for a spherical geometry with a radius much less than a wavelength of received and transmitted signals, to reduce thermal, shot, and phase noise, and wherein the geometric factor and the inverse geometric factor are equal to one for objects with geometries much larger than the wavelength of the received and transmitted signals.

16. A configurable device according to claim 1, wherein power requirements of the device are lower when the operating frequency of the plasma device is equal to the plasma frequency times a geometric factor instead of at a plasma frequency that is several times higher than or lower than the operating frequency.

17. A configurable device according to claim 1, wherein power requirements and phase, shot and thermal noise are reduced by using at least one of radioactive radon gas in the plasma means, the radon gas yielding self ionization through radioactivity, and radioactive seeds used in at least one of inert gases and mercury vapor.

18. A configurable device according to claim 1, wherein geometric factor is about 0.2 to about 3.0.

19. A configurable device according to claim 1, wherein geometric factor is about 0.577 to about 0.707 and the device includes a container for the plasma which is one of cylindrical or spherical shape.

20. A configurable device according to claim 1, wherein geometric factor is greater than 2.

21. A configurable device according to claim 1, wherein the geometric factor is greater than 10.

22. A configurable device according to claim 1, wherein said plasma device has a shape so that it can tune plasma frequencies in various parts of itself to phase shift multiple signals through the device.

23. A configurable device according to claim 1, wherein said plasma device has a donut shape, annular cylindrical shape, spherical shape, or spheriodal shape.

24. A configurable device according to claim 1, wherein a geometric resonance and a plasma resonance are used simultaneously to maximize aperture by matching the operating frequency to the geometric factor times the plasma frequency.

25. A configurable device according to claim 1, wherein the plasma device comprises an ionizable gas with Ramsauer-Townsend effects to reduce thermal, phase and shot noise.

26. A method for configuring a plasma device having a plasma ionizable at a plasma frequency, the plasma device for transmitting or receiving a source operating signal having an operating frequency to optimize the antenna aperture, internal electric field in the plasma, or internal current in the plasma, and reduce noise of the plasma device, the method comprising:

determining the operating frequency of the source operating signal; and adjusting at least one of the plasma frequency of the plasma device and the operating frequency of the source operating signal so that the operating frequency of the source operating signal equals the plasma frequency times a geometric factor characteristic of the devices;

pulsing the plasma to the plasma frequency with plasma ionizing energy pulses; and transmitting or receiving the source operating signal in a period between the energy pulses.

27. A method according to claim 26, further comprising determining the operating frequency of the source operating signal by sampling the operating signal to verify the operating frequency and readjusting the plasma frequency to approximate the verified operating frequency.

28. A method according to claim 26, wherein the plasma frequency is adjusted to the operating frequency within +/−10% of the operating frequency.

29. A method according to claim 26, wherein the geometric factor is about 0.3 to about 3.

30. A method according to claim 26, wherein the geometric factor is more than 2.

31. A method according to claim 26, wherein the geometric factor is more than 10.

32. A method according to claim 26, wherein adjustment of the plasma frequency adjusts impedance of the plasma device to maximize the efficiency of the plasma device to feeds, transmission lines, coaxial cables, and waveguides.

* * * * *